US010205245B2

(12) United States Patent
Falk et al.

(10) Patent No.: US 10,205,245 B2
(45) Date of Patent: Feb. 12, 2019

(54) PROTECTION APPARATUS FOR A HOLLOW CONDUCTOR AND METHOD FOR PRODUCING A PROTECTION APPARATUS

(71) Applicant: VEGA Grieshaber KG, Wolfach (DE)

(72) Inventors: Johannes Falk, St. Georgen (DE); Klaus Kienzle, Zell am Harmersbach (DE)

(73) Assignee: VEGA GRIESHABER KG, Wolfach (DE)

( * ) Notice: Subject to any disclaimer, the term of this patent is extended or adjusted under 35 U.S.C. 154(b) by 439 days.

(21) Appl. No.: 14/681,756

(22) Filed: Apr. 8, 2015

(65) Prior Publication Data

US 2015/0288069 A1 Oct. 8, 2015

(30) Foreign Application Priority Data

Apr. 8, 2014 (EP) ..... 14163905

(51) Int. Cl.
*H01Q 13/02* (2006.01)
*H01P 1/30* (2006.01)
(Continued)

(52) U.S. Cl.
CPC ..... *H01Q 13/02* (2013.01); *H01P 1/08* (2013.01); *H01P 1/30* (2013.01); *H01P 11/00* (2013.01); *H01P 11/002* (2013.01); *H01Q 1/225* (2013.01); *H01Q 13/0283* (2013.01); *Y10T 156/1052* (2015.01)

(58) Field of Classification Search
CPC .... H01Q 13/02; H01Q 1/225; H01Q 13/0283; H01P 11/002; H01P 1/08; H01P 1/30; H01P 11/00; Y10T 156/1052
See application file for complete search history.

(56) References Cited

U.S. PATENT DOCUMENTS 7,952,035 B2 5/2011 Falk et al.
2003/0030517 A1 2/2003 Munley et al.
(Continued)

FOREIGN PATENT DOCUMENTS

DE 32 43 823 5/1984
DE 8 604 529 8/1987
(Continued)

OTHER PUBLICATIONS

Explosive atmospheres—Part 1: Equipment protection by flameproof enclosures "d" IEC 60079-1:2007, Publication: Oct. 26, 2009, 82 sheets.

*Primary Examiner* — Jessica Han
*Assistant Examiner* — Michael Bouizza
(74) *Attorney, Agent, or Firm* — Fay Kaplun & Marcin.

(57) ABSTRACT

A housing apparatus is described which comprises a hollow conductor which is adapted for guiding an electromagnetic wave having a predeterminable wavelength and which comprises an edge surface which extends substantially perpendicularly to the propagation direction of an electromagnetic wave guided by the hollow conductor, wherein the housing apparatus comprises both a wall element and a protection apparatus having a bearing surface. The wall element holds the protection apparatus on an end of the hollow conductor by means of a pressing force.

18 Claims, 5 Drawing Sheets

(51) Int. Cl.

| | |
|---|---|
| ***H01P 11/00*** | (2006.01) |
| ***H01Q 1/22*** | (2006.01) |
| ***H01P 1/08*** | (2006.01) |

(56) References Cited

U.S. PATENT DOCUMENTS

| | | | | |
|---|---|---|---|---|
| 2010/0079348 | A1* | 4/2010 | Dietmeier ..... | H01Q 13/02<br>343/784 |
| 2010/0123615 | A1 | 5/2010 | Fehrenbach et al. | |

FOREIGN PATENT DOCUMENTS

| | | |
|---|---|---|
| DE | 40 09 918 | 10/1991 |
| DE | 43 30 067 | 11/1994 |
| DE | 199 50 429 | 4/2001 |
| DE | 10 2012 103 493 | 10/2013 |
| EP | 1 691 445 | 8/2006 |
| EP | 2 093 846 | 8/2009 |
| EP | 2 172 749 | 4/2010 |
| EP | 2 683 022 | 1/2014 |
| EP | 2 683 023 | 1/2014 |
| WO | 2000/029819 | 5/2000 |
| WO | 2001/029522 | 4/2001 |
| WO | 2010/0104461 | 9/2010 |

* cited by examiner

PROTECTION APPARATUS FOR A HOLLOW CONDUCTOR AND METHOD FOR PRODUCING A PROTECTION APPARATUS

REFERENCE TO RELATED APPLICATIONS

This application claims the benefit of the filing date of European Patent Application Serial No. 14 163 905.4 filed on 8 Apr. 2014, the disclosure of which is hereby incorporated herein by reference.

FIELD OF THE INVENTION

The invention relates to measurement technology. The invention relates in particular to a housing apparatus, a protection apparatus for a hollow conductor and a method for producing a protection apparatus.

TECHNICAL BACKGROUND

Field devices, in particular field devices which are used together with sensors to measure fill levels or limit levels, are often based on delay measurements. In delay measurements, the signal delays of radar signals or guided microwave pulses are determined. In general, the delay of an electromagnetic wave is measured. The desired measurement value, for example a fill level or limit level, is subsequently determined from these signal delays.

The signals are of a particular frequency. The radar signals and the microwave signals can be allocated to the high-frequency technology (HF technology) range. As signals which are in the high-frequency range, signals in the frequency range of up to 2 GHz are generally used as guided microwave signals, and signals in the range of from 5 GHz to 79 GHz and above are used as radar signals.

For safety reasons, it may be necessary for the electronics of the field device to be separated from the measurement environment, for example an inside of a container filled with a filling medium, in an explosion-protected manner. The separation consists for example of a gas-tight seal. This can prevent explosive substances or gas mixtures from the container interior reaching the electronics of the field device and igniting there. The IEC (International Electrotechnical Commission) standard TEC 60079-1:2007 is identical to the standard for explosive atmospheres, ÖVE-ÖNORM EN 60079-1, and relates to equipment protection by pressure-resistant enclosures "d" (Equipment protection by flame proof explosures "d" or enclosures "d"). Equipment which complies with explosion protection class "d", known as Exd equipment, meet the particular requirements for the construction and testing of electrical equipment in the pressure-resistant enclosure "d" type of ignition protection, which is intended to be used in regions at risk of gas explosions.

EP 2 093 846 A1 discloses a gas-tight conductor feed-through for a field device, which can provide explosion protection. The conductor feed-through is designed to be coaxial and is used for example in a frequency range of between 5 and 28 GHz.

EP 2 683 022 A1 describes a gas-tight hollow conductor coupling for coupling an electromagnetic transmission signal from a high-frequency module into a hollow conductor. The hollow conductor coupling may comprise a round disc made of a circuit board substrate, which has a metal-coated edge for soldered connection to the hollow conductor.

EP 2 683 023 A1 describes a hollow conductor coupling comprising a hollow conductor, the internal diameter of which widens towards a planar radiator element.

Antennae may be protected by means of a process separation and/or by means of a filling which covers the antenna opening and protects it from penetration by foreign substances. However, despite antennae being enclosed or being filled in part, it is possible that moisture may form in the hollow conductor.

SUMMARY OF THE INVENTION

The present invention relates to an effective sealing of a hollow conductor and/or of an HF module (high-frequency module) for a hollow conductor.

Accordingly, according to an aspect of the present invention, a housing apparatus, a protection apparatus for a hollow conductor and a method for producing a protection apparatus are described.

According to an aspect of the invention, a housing apparatus is described, which comprises a hollow conductor or wave guide which is adapted for guiding an electromagnetic wave having a predeterminable wavelength. The hollow conductor comprises an edge surface which extends substantially perpendicularly to an electromagnetic wave guided by the hollow conductor.

In addition, the housing apparatus comprises a wall element or wall device and a protection apparatus. In one example, the hollow conductor is incorporated in the wall element or wall device. This may mean that the edge surface is arranged perpendicularly to a longitudinal axis of the hollow conductor and/or of the protection apparatus.

A bearing surface is formed on the protection apparatus, which surface can come into contact with the edge surface of the hollow conductor. The wall element or wall device is adapted to absorb a force acting substantially perpendicularly to the propagation direction of the electromagnetic wave and/or to exert a force directed in this way. This means that the wall element or wall device is adapted to absorb a force acting substantially parallel to the bearing surface of the protection apparatus and/or to exert a force directed in this way. In other words, the wall element is designed to absorb a force acting substantially perpendicularly to a longitudinal axis of the hollow conductor and/or to the longitudinal axis of the protection apparatus and/or to exert a force directed in this way.

The wall element or wall device is formed at least in part as an antenna device and the antenna device comprises a process separation and/or a filling at one end. In particular, the antenna device can have a partial and/or complete filling. The process separation, enclosure and/or filling may substantially prevent penetration of undesired material or matter into the interior of the antenna device.

The protection apparatus is arranged on an end of the hollow conductor in such a way as to absorb and/or exert a force which is directed substantially perpendicularly to the propagation direction of the electromagnetic wave and/or which is directed substantially perpendicularly to the longitudinal axis of the protection apparatus or of the hollow conductor so that the bearing surface of the protection apparatus maintains contact with the edge surface of the hollow conductor. In other words, the protection apparatus is arranged on an end of the hollow conductor in such a way as to absorb and/or exert a force which is substantially parallel to the edge surface of the hollow conductor so that the bearing surface of the protection apparatus maintains contact with the edge surface of the hollow conductor.

In other words, this may mean that the protection apparatus separates the hollow conductor from the process in addition to the process separation and/or in addition to the filling. The process may denote a procedure which is carried out in a region provided for the process and in which products from a chemical reaction are produced and/or in which a filling material is found.

The process separation may prevent the atmosphere from penetrating inside the hollow body of the antenna, i.e. the penetration of the filling material or of a gas for example. However, minimal portions of the atmosphere or condensate, for example, may not be prevented from penetrating into the interior of the antenna. These penetrating portions may be prevented, by means of a protection apparatus cooperating with the process separation, from penetrating into a hollow conductor and from causing damage in the case when the hollow conductor is attached to the antenna device.

According to another aspect of the present invention, a protection apparatus for a hollow conductor is described. The hollow conductor is designed for guiding an electromagnetic wave having a predeterminable wavelength and comprises an edge surface which extends substantially perpendicularly to an electromagnetic wave guided by the hollow conductor, in particular to a longitudinal axis of the hollow conductor. The electromagnetic wave may correspond to a mode which is predetermined by the geometry of the hollow conductor.

The protection apparatus comprises a fastening device which is designed to fasten the protection apparatus to an end of the hollow conductor. In addition, the protection apparatus comprises a blocking device, the blocking device having a predeterminable sealing effect. By means of the sealing effect, the blocking device can substantially prevent the filling material and/or moisture from diffusing into the interior of the hollow conductor. The propagation direction of the electromagnetic wave may correspond to a longitudinal axis of the hollow conductor and/or to a longitudinal axis of the protection apparatus.

In addition, the blocking device is adapted to allow the electromagnetic wave guided by the hollow conductor to pass through in a substantially unattenuated manner. In one example, the blocking device may be low-attenuating for an electromagnetic wave. In other words, the blocking device may be adapted to block material or matter in a predeterminable direction and to allow electromagnetic waves to pass through in the opposite direction or in both directions. In one example, the blocking device may allow an electromagnetic wave to pass through in two directions, while blocking propagation of material in the direction of the hollow conductor.

The blocking device comprises a bearing surface which is arranged substantially perpendicularly to a longitudinal axis of the protection apparatus. The bearing surface is kept in substantially direct contact with the edge surface of the hollow conductor by the fastening device. The fastening device is designed to absorb a force acting substantially perpendicularly to the longitudinal axis and/or parallel to the bearing surface, and/or to exert a force acting substantially perpendicularly to the longitudinal axis and/or parallel to the bearing surface in order to keep the bearing surface in contact with the edge surface of the hollow conductor. The fastening device may absorb the fastening forces and thus leave the blocking device substantially unloaded.

By applying pressure in a direction which is parallel to the bearing surface, a gap, which may be present between the protection apparatus and a wall element of a hollow conductor, can be reduced so that a passage of undesired matter or material such as moisture, condensate or a filling material, can be prevented. The gap to be sealed may be formed substantially parallel to the propagation direction of an electromagnetic wave. By means of the pressure on the fastening device, the contact between the bearing surface and the edge surface can be set, in the direction which is substantially perpendicular to the propagation direction of the electromagnetic wave, such that propagation of material is also prevented in this direction. The protection apparatus is held in the interior of the wall element by means of the pressure. The protection apparatus may be pressed into the interior of the wall element such that a press fit is formed between the wall element and the protection apparatus, holding the protection apparatus in place. In particular, the protection apparatus may form a press fit together with the inner wall of the hollow conductor and/or the antenna device. The sealing standard Exd and/or IP67 may be met by means of the press fit.

According to yet another aspect of the present invention, a field device is specified, which comprises the housing apparatus. The field device may be a fill level measuring instrument, in particular a measuring instrument which uses the free propagation of electromagnetic waves and/or the propagation of guided microwaves.

According to another aspect of the present invention, a method for producing a protection apparatus is described. The method comprises providing a stainless steel ring having a predeterminable external diameter. In addition, the method comprises providing a film which has a predeterminable sealing effect and is substantially permeable to an electromagnetic wave. In one example, the film is produced from PTFE or PFA and has a thin cross section. In one example, the cross section of the film can be so thin that the film is freely movable inside the stainless steel ring and is not rigid.

The film is laminated onto the stainless steel ring in such a way that at least one of the two openings of the stainless steel ring is sealed by the film. The film is consequently cut in such a way that it aligns with the external diameter of the stainless steel ring. A gap between the film and the stainless steel ring or the press-in ring may be substantially sealed by means of the lamination. The press-in ring or stainless steel ring is adapted to absorb a pressure which is produced when pressing said ring into the wall element.

The blocking device may be produced from a material which has only a low pressure absorption capacity. By providing a fastening device which can absorb a higher pressure than the blocking device, the blocking device can be designed for installation in a housing by using a specific pressure, the pressure being in a range which allows the Exd standard to be met in order to seal a gap according to the Exd standard. A hollow conductor wall located behind the blocking device can also absorb a correspondingly high pressure in cooperation with the fastening device.

A protection apparatus for a hollow conductor can also be referred to as a diffusion barrier or a hollow conductor diffusion barrier. A hollow conductor diffusion barrier can prevent in an antenna system for a high-frequency radar level sensor, for example, condensate or condensation from ascending or rising into the hollow conductor system. In the case of antennae or antenna devices which are enclosed, encapsulated or filled in part, the filling may be in contact with the medium to be measured. However, a cavity may be located behind the filling of the antenna, i.e. towards the hollow conductor or towards an HF module, which cavity is filled for example with air. If moisture or fluid were to reach said cavity through the filling of the antenna due to diffusion, the moisture could be present directly below a microwave hollow conductor and/or directly on the HF module, in particular on electronics. In this case, the moisture would be in very close proximity in the region of the HF module and could cause damage to the electronics of the HF module. In other words, despite meeting the Exd requirements of an antenna which is filled, is encapsulated or is enclosed by a process separation, moisture can build up on the HF module if no protection apparatus is used. The protection apparatus may prevent moisture from appearing between the protection apparatus and the HF module. The effect of the protection apparatus can be increased by using an Exd separating element, a zone separating element or a glass window within the hollow conductor, such that no more moisture appears substantially after the disc or after the Exd separating element.

In order to prevent the moisture or fluid from rising up, which can pass through the enclosure or filling of the antenna from a lower end of the hollow conductor through the hollow conductor towards the hollow conductor or even as far as the electronics of the HF module, the protection apparatus can be installed in the hollow conductor at a suitable place or location. The protection apparatus or the hollow conductor diffusion barrier may be provided as the only measure and/or as a measure in addition to the enclosure or the filling of the antenna. In particular, the cooperation of the enclosure, the process separation and/or the filling with the diffusion barrier can protect the HF module.

By means of the protection apparatus, a further device for curbing diffusion is provided in the hollow conductor in an antenna system or a hollow conductor system in addition to the process separation. The protection apparatus or the device for curbing diffusion may make it possible to protect the HF module or the electronics not only against a penetrating filling material, fluid or gas or against penetrating solid substances or dust, but also against penetrating moisture. Design as a clamp part or a press-in part or the provision of a snap fastener may allow simple assembly of the protection apparatus inside the hollow conductor. The protection apparatus may cooperate with the process separation and/or the filling and thus form dual or multiple protection. The further the respective protection measures are from the filling material, the more effective the protection effect may be. For example, the process separation may provide coarse protection against material penetrating into the interior of the hollow conductor, and the protection apparatus can provide fine protection.

The shaping of the protection apparatus may cause beam forming of the electromagnetic wave extending through the protection apparatus, and may contribute to beam forming. For the purpose of beam forming or beam formation, the protection apparatus, in particular the blocking device, can be adapted to be conical, spherical or lens-shaped.

By arranging the diffusion barrier in a location which is further from an existing filling material, gas or fluid and is closer to the electronics, the electronics and the hollow conductor itself can be protected from penetrating moisture. In other words, the protection apparatus can act as an enclosure for the hollow conductor inside the hollow conductor itself. The protection apparatus can supplement the coarse protection at an end of the antenna, in particular at an antenna opening and/or at a hollow conductor opening. The protection apparatus can substantially provide protection in the interior of an antenna device and/or in the interior of a hollow conductor. The coarse protection may be provided, for example, by a process separation and/or a filling.

Aside from the simple assembly by means of clamping, pressing-in or pressing in a sealing manner, these types of connection can also produce a sealed connection between the protection apparatus and the hollow conductor wall and/or the antenna wall. Additional work due to soldering can be dispensed with. In particular, the protection effect can be provided by forming the protection apparatus as a turned part which is clamped in, pressed in or pressed in a sealing manner. The production as a turned part in particular allows the protection apparatus to be formed in a gap-free, one-piece or monolithic construction, which reduces the presence of gaps when compared with a modular construction.

In addition, a sealed connection can be produced by laminating films of material, for example a PTFE (polytetrafluoroethylene), a PTFA (Teflon, polytetrafluoroethylene) or a PFA (perfluoroalkoxy polymer) film onto stainless steel.

The protection device or hollow conductor diffusion barrier can be arranged for example in a high-frequency radar level sensor system between the process separation and the electronics or between the process separation and the Exd separating element. The Exd separating element is a separating element which has explosion protection properties which correspond to the Exd standard TEC 60079-1:2007.

The fastening device is adapted to absorb a force acting substantially parallel to the bearing surface of the protection apparatus and/or to exert a force acting substantially parallel to the bearing surface in order to keep the bearing surface in contact with the edge surface of the hollow conductor.

According to another aspect of the present invention, the protection apparatus is formed in one piece or in a monolithic manner. For example, the protection apparatus or condensate barrier is formed as a turned part. On account of being produced in one piece, substantially the entire protection apparatus is formed as a blocking device and the blocking device therefore substantially has no holes, gaps or slits through which moisture could pass the blocking device. The pores of the material used for the blocking device can be so narrow that said device is substantially impermeable to moisture, water or other matter or material, for example matter or material which is used as a filling material.

According to another aspect of the present invention, the fastening device of the blocking device or blocking apparatus is designed as a snap fastener.

The blocking device or blocking apparatus may be formed, for example, as a cap, an enclosure or a lid for a housing apparatus or for a housing adapter. The snap fastener can allow the edge surface of a hollow conductor, in particular the edge surface of a hollow conductor opening, and the bearing surface of the protection apparatus to be arranged close to one another.

According to another aspect of the present invention, the fastening device comprises a press-in ring. The press-in ring may, in contrast with the blocking device, be produced from a highly pressure-resistant material such as stainless steel. Said press-in ring may absorb the pressure forces or compressive forces acting parallel to the bearing surface and position the blocking device, by means of the pressing, in front of an opening of the hollow conductor in such a way that substantially no moisture or any other material can diffuse through between the gaps which are present. In other words, gaps which occur on account of the modular construction of an antenna-hollow conductor system comprising a plurality of components are minimised by means of the applied pressure in such a way that they can be deemed sealed in accordance with standard IP67.

According to yet another aspect of the present invention, the blocking device is produced from a material which is selected from the group of materials, said group of materials consisting of a dielectric material, PFA, PTFE, PEEK (polyether ether ketone), FKM (fluoroelastomer or fluoro rubber), FFKM (perfluoro-elastomer or perfluoro rubber) or silicone.

Production from a dielectric material can ensure that an electrical resistance or an impedance of the protection apparatus is low for a high-frequency electromagnetic wave, so that said protection apparatus causes substantially no resistance to an electromagnetic wave. The dielectric material is distinguished on the basis of the dielectric constant (DK, $\varepsilon_r$). In other words, the material for the blocking device and/or the material for a protection device formed in one piece can be selected such that when it is struck by an electromagnetic wave, substantially no reflections occur in a direction which is opposite to the propagation direction of the electromagnetic wave.

According to another embodiment of the present invention, the protection apparatus comprises a stainless steel ring as a fastening device. In addition, the protection apparatus comprises a film as a blocking device. The film may have a predeterminable sealing effect for material or for a gas and can be substantially permeable to an electromagnetic wave.

The stainless steel ring may substantially comprise two openings which are covered by the film in such a way that said film seals or covers at least one of the openings of the stainless steel ring. The film may be laminated onto the stainless steel ring, by means of which a strong sealing effect can be achieved. The lamination technique makes it possible to apply a thin film to the ring.

According to another aspect of the present invention, the blocking device is formed in the shape of a disc, a cone, a lens and/or a sphere. Beam forming of the electromagnetic wave can be achieved by means of the shaping of the blocking device.

According to another aspect of the present invention, a housing apparatus is described. The housing apparatus comprises a hollow conductor which is adapted for guiding an electromagnetic wave having a predeterminable wavelength and which comprises an edge surface at one end extending substantially perpendicularly to the electromagnetic wave guided by the hollow conductor. The edge surface of the hollow conductor may be formed from the housing apparatus in which the hollow conductor is set. In particular, the wall element or wall device of the housing apparatus may comprise the edge surface at the edge of a hollow conductor opening, such that the surface of a hollow conductor opening lies in the same plane as the edge surface. In other words, a normal vector which is perpendicular to the hollow conductor opening may extend parallel to a normal vector which is perpendicular to the edge surface.

In addition, the housing apparatus comprises a protection apparatus, wherein the protection apparatus is arranged on an end of the hollow conductor in such a way that it applies a force perpendicularly to the edge surface of the hollow conductor, so that the bearing surface maintains contact with the edge surface of the hollow conductor.

A housing apparatus of this type, which is covered by means of a protection apparatus or a condensate barrier, can be referred to as an enclosed housing adapter or an encapsulated housing adapter. By attaching the protection apparatus or by snapping on the protection apparatus, for example by using a snap fastener, the housing adapter, in particular the interior of a housing adapter, may be sealed against penetrating moisture or material.

According to yet another aspect of the present invention, a housing apparatus may be produced which comprises a hollow conductor which is adapted for guiding an electromagnetic wave having a predeterminable wavelength and which comprises, at one end, an edge surface extending substantially perpendicularly to the electromagnetic wave guided by the hollow conductor or to a longitudinal axis of the hollow conductor. The housing apparatus may in addition comprise a wall element or wall device and a protection apparatus according to the invention. The wall element is adapted in such a way that a force acting substantially parallel to the bearing surface of the protection apparatus is applied by the wall element, and wherein the protection apparatus is arranged in the wall element in such a way that the bearing surface of the blocking device is kept in contact with the edge surface of the hollow conductor. A force acting parallel to the bearing surface of the protection apparatus may act perpendicularly to a normal vector which is perpendicular to the bearing surface. Consequently, the parallel force, which is applied by a housing wall for example, may also act perpendicularly to a normal vector which is perpendicular to the edge surface of a hollow conductor.

By means of the contact being maintained, a gap between the bearing surface of the blocking apparatus and the edge surface of the hollow conductor can be substantially closed, and the firm holding, for example by means of pressing into the wall element, means that a gap between the wall element and the protection apparatus can be reduced such that substantially no material can approach the hollow conductor opening. The sealing effect, however, is substantially determined by the closely adjacent arrangement of the bearing surface and the edge surface. In other words, the wall element may press the protection apparatus firmly against the opening of a hollow conductor in such a way that the opening of the hollow conductor is substantially sealed and closed off against penetration of material and a gap between the fastening device and the wall element or wall device is substantially closed.

According to yet another aspect of the present invention, part of the wall element of the housing apparatus is formed as an antenna device. The antenna device is adapted for guiding and beam forming of an electromagnetic wave received by the hollow conductor, wherein the protection apparatus is arranged between the hollow conductor and the antenna device. In other words, the protection apparatus may cover a passage or transition from the interior of the hollow conductor to the interior of the antenna device. A combination of the hollow conductor and the antenna device can be referred to as a hollow conductor-antenna system or an antenna-hollow conductor system. The protection apparatus may divide a hollow conductor-antenna system into two different regions. An electromagnetic wave and/or electromagnetic energy may be exchanged between the two regions of the hollow conductor, but a flow of material between the separated regions is substantially prevented. An antenna device can also be understood to be part of a hollow conductor. Thus, the combination of the hollow conductor and the antenna device can be interpreted as a single hollow conductor, inside which a protection apparatus is arranged, which device divides the hollow conductor into different regions.

An antenna device may differ from a hollow conductor in that an antenna device is provided for the purpose of beam forming. The beam forming may result in an antenna characteristic which can be specifically assigned to the antenna device and is possible to be presented as an antenna characteristic of the antenna device. The hollow conductor may have a further portion for matching or adapting an impedance or a wave resistance of the hollow conductor to the wave resistance of the antenna device in order to ensure that an electromagnetic wave is guided in a manner which is as free from reflections as possible. This transition region of the hollow conductor and/or the antenna device may be conical.

The hollow conductor may comprise a pipe or a trumpet shaped pipe having a longitudinal axis, the hollow conductor being axisymmetric. The hollow conductor may be designed to be substantially cylindrical. The antenna device may, in one example, be conical and may also have a longitudinal axis. The longitudinal axis of the hollow conductor may correspond to the longitudinal axis of the antenna device or of the hollow conductor in a state in which it is connected to the antenna device. The antenna device may adapt or match the wave resistance of the antenna device to a surrounding atmosphere, for example to air, gas or another filling material. The walls of the hollow conductor and of the antenna device may be at different angles to one another. The angles may be measured relative to the longitudinal axis.

According to yet another aspect of the present invention, the antenna device can be separated from the housing apparatus. The protection apparatus may, for example, be inserted at the separation point between the antenna device and the housing apparatus, and the antenna-hollow conductor system or the hollow conductor-antenna system may be assembled in a modular manner. In other words, the housing apparatus may comprise a partial housing comprising the hollow conductor, and the antenna device may comprise a housing part comprising the antenna device. The antenna part containing the hollow conductor may be referred to as the housing adapter, while the part comprising the antenna device may be referred to as the antenna housing. The separable design or modular design may permit the housing adapter and the antenna housing to be assembled in order to form the hollow conductor-antenna system.

According to yet another aspect of the present invention, a field device is described which comprises a sensor and the housing apparatus according to the invention. The sensor, for example an HF module, is designed to generate and/or receive an electromagnetic wave. The sensor may, in one example, be designed as a two-wire system, in which energy is supplied solely via the measuring lines.

The sensor may force or induce an electromagnetic wave into a hollow conductor housing apparatus. The protection apparatus of the housing apparatus may protect the sensor from penetrating moisture or condensate. In particular, the protection apparatus may protect the sensor from moisture which penetrates from the direction of the hollow conductor.

According to yet another aspect of the present invention, the protection apparatus comprises a stainless steel ring and a film.

The stainless steel ring may be able to absorb a high pressing force which can occur for example when pressing the protection apparatus into a housing apparatus. By using the stainless steel ring the film can be held in position in front of the hollow conductor by means of the pressing force and assembly in a corresponding position such that the film substantially prevents moisture from penetrating into the opening of the hollow conductor, but allows electromagnetic radiation to pass through. The pressing-in may result in the sealing requirement according to the standard IP67 being met.

The sealing effect of the blocking apparatus or blocking device may be predetermined by a leak rate, which for example is given in the unit mbar l/sec. The unit mbar indicates the pressure in millibars, l indicates a volume in liters, and sec indicates the time measured in seconds.

It should be noted that different aspects of the invention have been described with respect to different subject matter. In particular, some aspects have been described with respect to apparatus claims, while other aspects have been described with respect to method claims. However, a person skilled in the art will be able to discern from the description provided above and from the following description that, apart from when indicated otherwise, in addition to any combination of features which belongs to a category of subject matter, any combination of features which relates to different categories of subject matter is also considered as being disclosed by this text. In particular, a combination of features of apparatus claims and features of method claims should also be disclosed.

BRIEF DESCRIPTION OF THE DRAWINGS

In the following, further embodiments of the present invention will be described with reference to the figures.

DETAILED DESCRIPTION OF EMBODIMENTS

Figure 1:
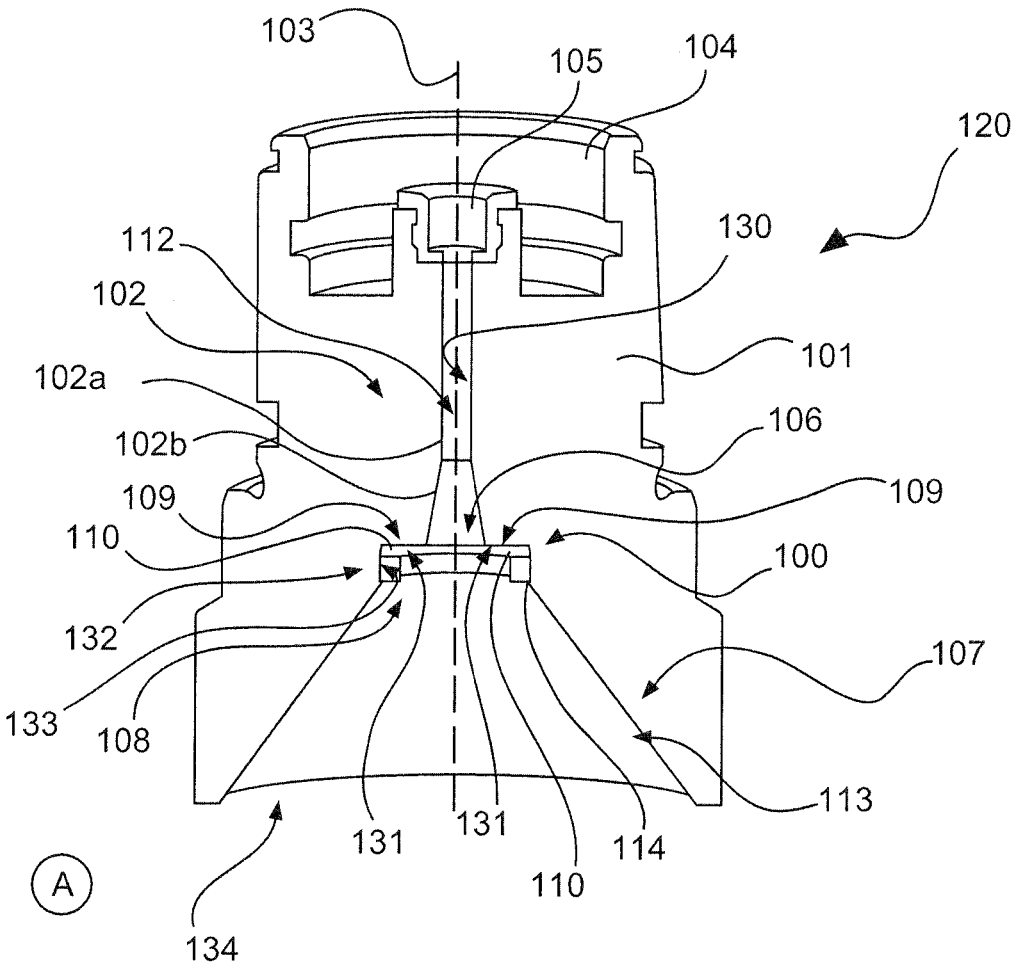
FIG. 1 shows a cross section of a housing apparatus comprising a protection device according to an exemplary embodiment of the present invention.

The drawings are schematic and not to scale.

In the following description of FIGS. 1 to 9, the same reference numerals are used for the same or corresponding elements. However, like or similar elements may also be denoted by different reference numerals.

FIG. 1 shows a cross section of the housing apparatus 120, which is formed from a single piece, according to an exemplary embodiment of the present invention. The housing apparatus 120 comprises the wall element 101 or wall device 101 in which the hollow conductor 102 is embedded. In one example, the hollow conductor is produced in the interior of the wall element. In another example, the hollow conductor is a metal pipe which is incorporated into the wall element. The hollow conductor 102 is incorporated into the wall element 101, for example by drilling. The housing adapter is produced from plastics material for example, which is coated internally, i.e. on the hollow conductor wall 130, with an electrically conductive material in order to guide an electromagnetic wave along the hollow conductor 102 or wave guide 102. The hollow conductor 102 or wave guide 102 comprises a pipe-shaped portion 102*a* and a conical portion 102*b*.

The hollow conductor is an axisymmetric or a rotationally symmetric structure, which is produced symmetrically with respect to the longitudinal axis 103. The external contours of the housing 120 are also produced rotationally symmetrically with respect to the longitudinal axis 103. The longitudinal axis 103 may extend parallel to a propagation direction of an electromagnetic wave in the hollow conductor.

An HF cup (high-frequency cup), a sensor, or the HF module, together with the electronics thereof, can be integrated into a cavity 104 or HF cavity 104 shown in the top region in FIG. 1. The HF module and the HF cup are not shown in FIG. 1. The HF module or the sensor can be positioned in the HF module cavity 105. The HF module cavity 105 and the HF cavity 104 are both designed to be cylindrical. However, the HF module cavity 105 is designed to be smaller than the HF cavity 104. The HF module can generate an electromagnetic wave in the HF module cavity 105, which wave travels along the longitudinal axis 103 towards the hollow conductor opening 106 as a transmission signal. The hollow conductor opening 106 is determined by the conical portion 102*b*. The diameter of the hollow conductor opening 106 corresponds to a diameter which is dependent on the guided wavelength and the subsequent antenna device 107. In other words, the diameter of the opening 106 ensures a transition which is as free of reflections as possible into the conical region 107 denoted by reference numeral 107 which forms the antenna device 107 or the antenna 107 of the hollow conductor-antenna system 120. The antenna device 107 can itself be interpreted as a hollow conductor portion which is separated from the cylindrical hollow conductor portion 102*a* and/or the conical hollow conductor portion 102*b* by the protection apparatus 100. The transition location, on which the protection apparatus 100 is arranged, is designed such that a reflection value produced by the protection apparatus and the transition is minimal. The minimum can be determined by tests, by minimising the S11 parameter. In particular, the hollow conductor 102 and the antenna device 107 are electrically adapted or matched to one another.

The conical antenna region 107 is also incorporated into the wall element 101 in a rotationally symmetrical manner and coated with an electromagnetically conductive material. The protection apparatus 100 is integrated between the antenna opening 108 in an input region of the antenna 107 which forms the antenna input 108, and the opening 106 of the hollow conductor 102 which forms an output of the hollow conductor 102. The protection apparatus 100 is designed as a stainless steel ring 114 or a press-in ring 114 which is sealed by a film 110. The protection device 100 is pressed in at the press-in location 133, which also corresponds to an annular region inside the wall element 101, such that the bearing surface 109 of the blocking device 100 is positioned on a shoulder 131 of the wall element 101 extending perpendicularly to the longitudinal axis 103. Since the shoulder is part of the wall element 101 and thus also part of an edge region of the hollow conductor 102, the blocking device 110 is positioned together on the edge surface 131 of the hollow conductor 102 by using the bearing surface 109.

The press-in location 133 of the wall element 101 exerts a pressing force on the casing surface 132 of the press-in ring 114. The interior region 112 of the hollow conductor 102 can be sealed off from the interior region 113 of the antenna device 107 by means of the pressing on the locations 133, 132 and/or the abutting to the edge surface 131 of the hollow conductor. Both the pressing 133, 132 and the film 110 prevent diffusion of matter or material between the cavity 113 of the antenna 107 and the cavity 112 of the hollow conductor 102. Moisture which is still penetrating into the lower region 113 of the antenna device 107 can thus be substantially prevented from rising further towards the HF module cavity 105. The pressing forces are substantially absorbed by the stainless steel ring 114 of the protection apparatus 100, with the result that the blocking device 110 is substantially free from high compressive forces or pressing forces. The blocking device 110 maintains contact, by means of the bearing surface 109 thereof, with the edge surface, wherein selecting pressure with which the bearing surface 109 and the edge surface 131 are pressed together is possible as desired. The hollow conductor opening 106 is consequently sealed.

The blocking apparatus 100 can substantially prevent material from rising through the antenna device 107 from a container region or process region denoted by the letter "A" in FIG. 1 towards the HF module cavity 105, although both the antenna device 107 and the hollow conductor 102 are substantially unfilled or hollow. In FIG. 1, "A" denotes a region below the HF module cavity 105. The filling material may be located in region "A". In one example, the interior region 113 of the antenna device 107 may be encapsulated, sealed or casted by material or the antenna opening 134 may be closed by means of an enclosure, a capsule or a casing. However, despite a process separation of this type (not shown in FIG. 1), condensate may still penetrate into the hollow conductor 102. The protection apparatus 100 may prevent additional penetration of the condensate into the hollow conductor 102, in particular into the interior region 112 of the hollow conductor 102.

Figure 2:
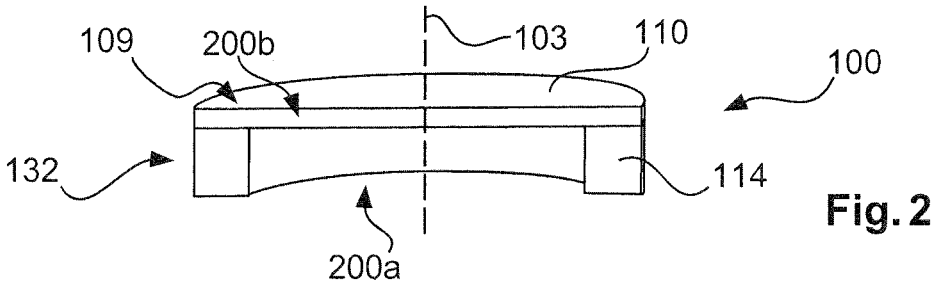
FIG. 2 shows a cross section of a protection apparatus according to an exemplary embodiment of the present invention.

FIG. 2 shows a cross section of the protection apparatus 100 from FIG. 1 according to an exemplary embodiment of the present invention. FIG. 2 shows a disc-shaped protection apparatus 100. The disc-shaped protection apparatus comprises a disc 110 as a blocking device. Said disc 110 or disc-shaped blocking device 110 is arranged on a stainless steel press-in ring 114 which is produced from stainless steel and comprises the two openings 200*a* and 200*b*. If the disc-shaped blocking device 110 is formed to be very thin, the blocking device 110 can be referred to as a disc-shaped film 110 or a film 110. The film 110 is laminated onto one of the openings 200*b* as a blocking device 110. The film 110 is produced from PFA or PTFE material and covers one of the two openings 200*a*, 200*b* so that there can be substantially no flow of material through the openings 200*a*, 200*b*. In FIG. 2, the covered opening 200*b* may be referred to as the upper opening of the stainless steel press-in ring 114. The opening 200*a* may be referred to as the lower opening. The lower opening may face a filling material when used in a hollow conductor. The protection apparatus 100 is shown as an axisymmetric element with respect to the longitudinal axis 103. The protection apparatus 100 comprises a bearing surface 109 which can come into contact with the edge surface 131 of a hollow conductor. In particular, the bearing surface 109 is the part of the protection apparatus which is in contact with the fastening device 114. The film 110 is laminated onto the stainless steel ring 114 in the form of a membrane. In one example, the bearing surface 109 substantially corresponds to an edge surface of the stainless steel ring 114.

Figure 3:
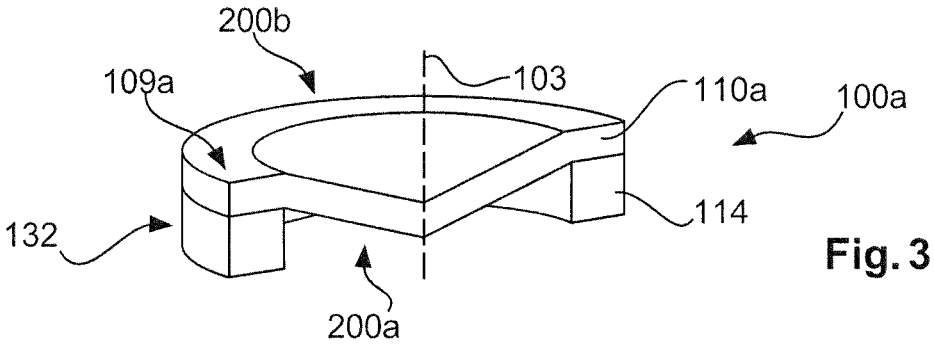
FIG. 3 shows a conical protection apparatus according to an exemplary embodiment of the present invention.

FIG. 3 shows a conical protection device according to an exemplary embodiment of the present invention. When producing the protection apparatus 100*a* as a cone, the film 110*a*, which may be produced from PFA or PTFE, is laminated onto the stainless steel press-in ring 114. The bearing surface 109*a* is formed on the blocking device 110*a* along the stainless steel ring 114, in particular along an edge surface of the stainless steel ring 114. The blocking device 110*a* covers the upper opening 200*b* but is designed to be conical along the axis of symmetry 103 towards the lower opening 200*a*. Said conical design can be used for beam formation or beam forming.

Figure 4:
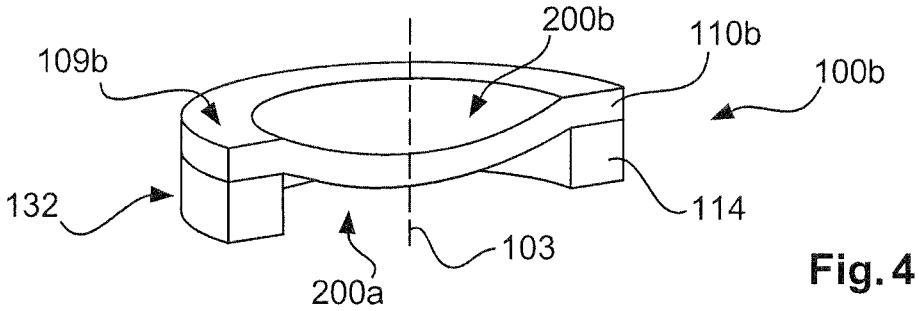
FIG. 4 shows a spherical protection apparatus according to an exemplary embodiment of the present invention.

FIG. 4 shows a spherical protection apparatus 100*b* which comprises the stainless steel ring 114 and the film 110*b*. The bearing surface 109*b* is formed on the blocking device 110*b* along the stainless steel ring 114, in particular along an edge surface of the stainless steel ring 114. The film 110*b* is laminated onto the stainless steel press-in ring 114 as a blocking device 110*b* and covers the opening 200*b* of the stainless steel ring. The film, which may be produced from PFA or PTFE, is spherical towards the lower opening 200*a*. The blocking apparatus 100*b* is produced so as to be rotationally symmetrical with respect to the longitudinal axis 103. Beam forming can be achieved by the spherical or lens-shaped design.

As shown in FIG. 2, a protection apparatus may be produced in the form of a PFA disc 110 or a PTFE disc 110 which is laminated onto a stainless steel ring 114. A condensate-tight connection can be produced between a metal ring 114 and a disc 110 by means of a laminated connection. A condensate-tight connection may mean that the press-in ring 114 can be pressed so firmly against a housing wall 101 of the housing 120 at the location 133 that substantially no condensate can pass through said pressing. The pressing is carried out in such a way that the sealing complies with the standard IP67. The pressing locations 132, 133 take the form of a press fit or an interference fit in such a way as to allow assembly by means of pressing. This means that the protection apparatus 100 is held inside the hollow conductor-antenna system 120 substantially solely by the pressing force of the wall element 101.

As shown in FIGS. 3 and 4, the blocking device or blocking apparatus 110, 110*a*, 110*b* can be shaped when laminating the disc 110, 110*a*, 110*b*. For the purpose of shaping, the disc is pressed into an appropriate shape. By means of shaping, a conical protection apparatus 100*a* or a spherical protection apparatus 100*b* can be produced, as can a lens-shaped protection apparatus (not shown). Due to said shapes, for example the conical, spherical or lens shape, microwaves in a hollow conductor 102 can pass in a low-attenuated manner from the hollow conductor through the protection device.

Despite the presence of a process separation (not shown in FIG. 1) and despite other protection measures which are intended to prevent material or condensate from penetrating from region A into the antenna device 107 or into the interior 113 of the antenna device 107, small amounts of the condensate may develop inside the hollow conductor-antenna system 120, i.e. inside the combination of the hollow conductor 102 and the antenna device 107. Said condensate may both affect the measuring signal and produce a damaging effect in an HF module arranged in the HF module cavity 105 if said condensate penetrates as far as the module. In particular, condensate which develops behind a process cover (not shown in FIG. 1) on the antenna opening 134 in the antenna region 107 or in the antenna device 107 may lead to measuring errors. On the other hand, condensate which develops in the hollow conductor 102, in particular in the interior of the hollow conductor 112, and perhaps even penetrates to the HF module in the HF module cavity 105 may lead to the omission of a measurement. The diffusion barrier 100 or the protection apparatus 100, which is incorporated in addition to a process separation or process cover (not shown in FIG. 1), can as far as possible prevent moisture, material, condensate or a gas from further rising up towards the HF module cavity 105 from region "A", and can thus contribute to secure or accurate measuring. The protection apparatus 100 is arranged parallel to the antenna opening 134 and/or parallel to the hollow conductor opening 106. In particular, the longitudinal axes 103 of the protection apparatus 100 are arranged parallel to the longitudinal axis of the antenna opening 134 and/or parallel to the longitudinal axis of the hollow conductor opening 106. Or, in other words, the surface of the protection apparatus 100 is arranged parallel to the surface of the antenna opening 134 and/or parallel to the surface of the hollow conductor opening 106.

Figure 5:
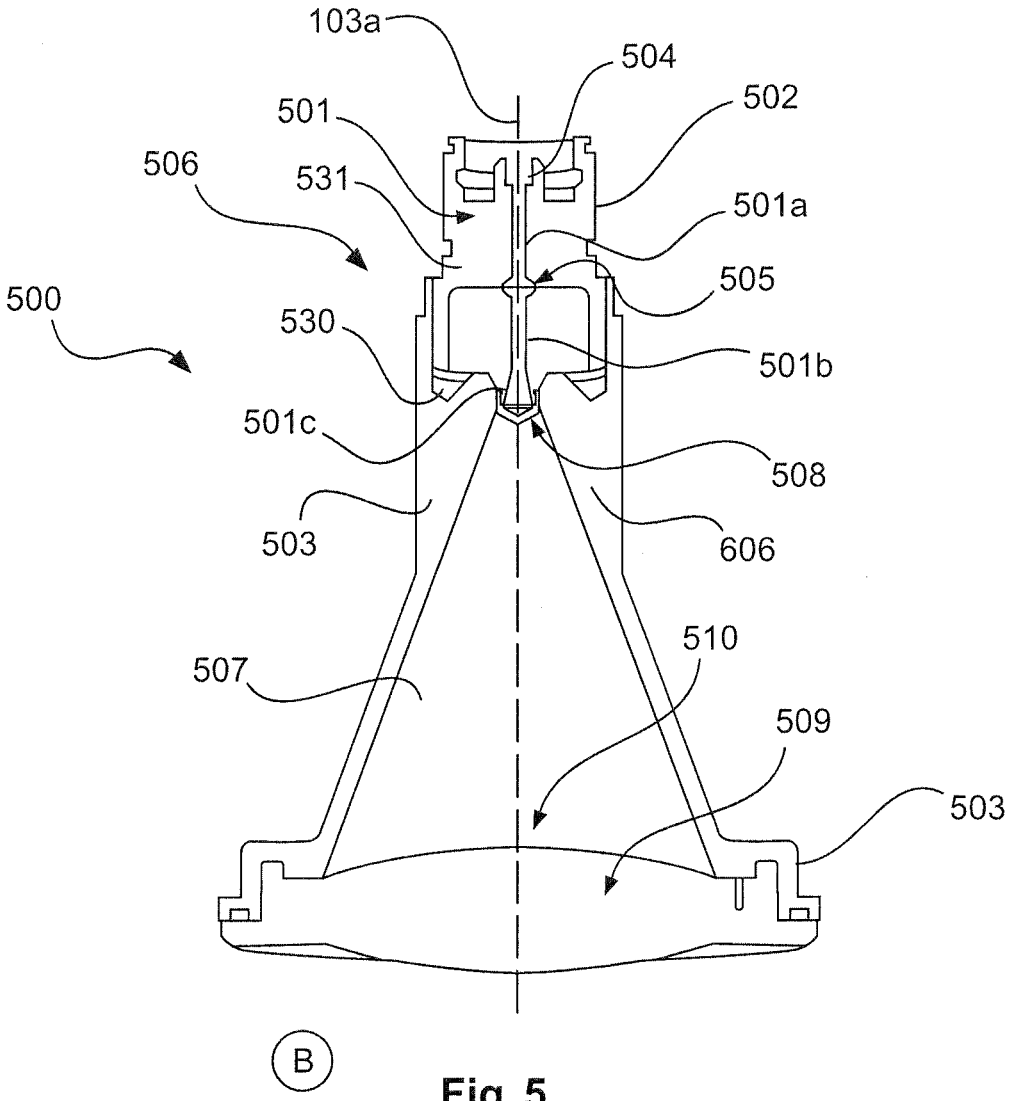
FIG. 5 shows a modular housing apparatus comprising a protection apparatus according to an exemplary embodiment of the present invention.

FIG. 5 shows a cross section of a modular housing apparatus comprising a protection apparatus according to an exemplary embodiment of the present invention. The housing apparatus 500 is constructed from two elements 502, 503 which can be separated from one another. The housing element 502 or housing device 502 which contains the hollow conductor 501, or the housing adapter 502, is attached to the housing element 503 or housing device 503 which contains the antenna device 507. The hollow conductor housing device 502 or the housing adapter 502 can be separated from the antenna housing device 503 containing the antenna device 507. The housing adapter 502 comprises the HF module cavity 504, and the hollow conductor 501 is constructed from two hollow conductors 501*a* and 501*b*. The HF module cavity 504 can receive an HF module (the HF module is not shown in FIG. 5). The hollow conductor 501*a* and the hollow conductor 501*b* are separated by means of the Exd separating element 505. Said Exd separating element is formed as a glass window. The Exd separating element is a zone-separating element and divides the hollow conductor 501 into two regions 501*a*, 501*b* which are separated from each other.

The housing adapter 502 and the housing device 503 of the antenna come into contact in the coupling region 506. The protection apparatus 508 is arranged between the hollow conductor housing device 502 and the antenna housing device 503. The protection apparatus 508 is designed as a condensation barrier and is formed in one piece as a turned part.

Figure 5A:
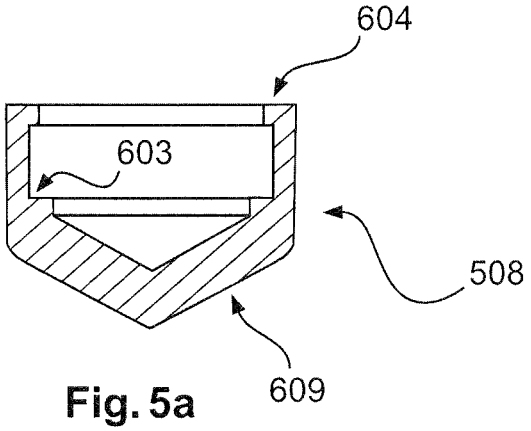
FIG. 5*a* shows a protection apparatus formed in one piece according to an exemplary embodiment of the present invention.

FIG. 5*a* shows a protection apparatus 508 formed in one piece according to an exemplary embodiment of the present invention. The one-piece and gap-free construction should be noted, in which the functional regions of the fastening device 604, the protection device 609 and the bearing surface can be distinguished.

Figure 6:
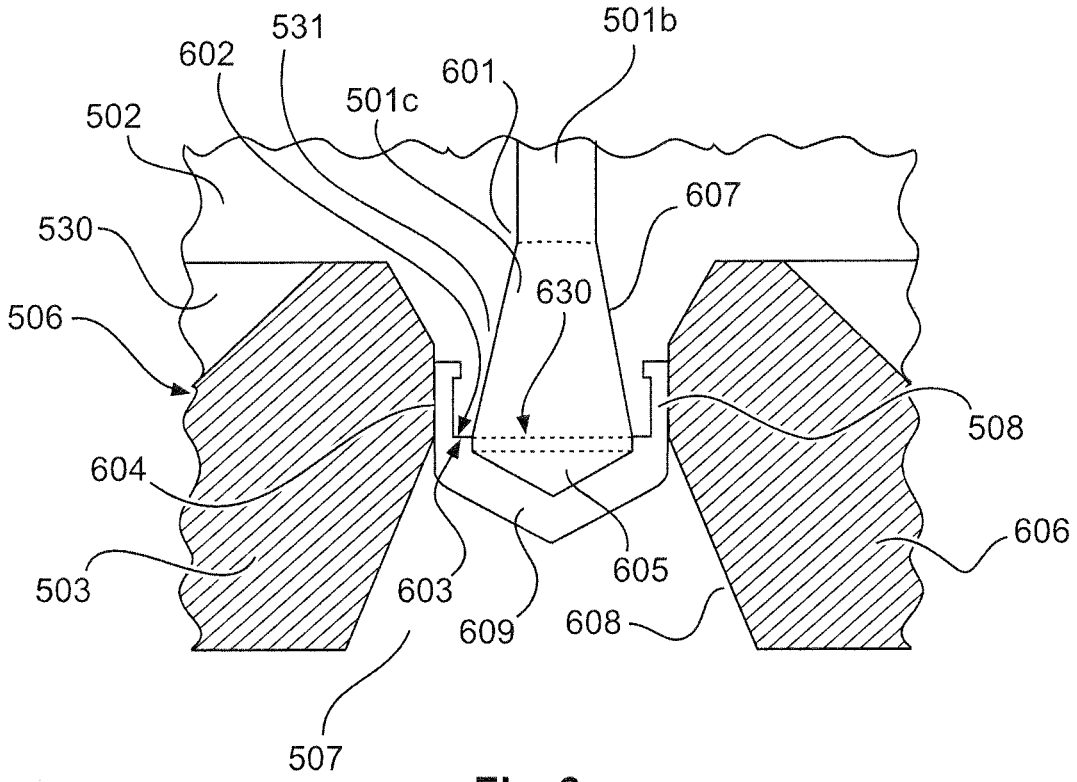
FIG. 6 shows a detail of the coupling region of FIG. 5 according to an exemplary embodiment of the present invention.

FIG. 6 shows a detail of the transition region or coupling region 506 of FIG. 5 according to an exemplary embodiment of the present invention. FIG. 6 shows the trumpet-shaped end 501*c* of the hollow conductor 501. In addition, the housing wall or wall element 601 of the housing device 502 is portrayed, into which wall device the hollow conductor is incorporated. The hollow conductor 501*b*, 501*c* is incorporated into the housing wall element 601 as a pipe-shaped portion. The hollow conductor 501*c* comprises the edge surface 602. Said edge surface 602 can come into contact with the bearing surface 603 of the blocking device 508.

The protection apparatus 508 is fixed to the hollow conductor 501*c*, in particular to the wall device 502, the wall element 502 or the wall 502 of the hollow conductor, by means of the snap fastener 604 which represents the fastening device 604 of the protection apparatus 508. The wall element 502 of the hollow conductor 501*c* thus comprises corresponding recesses in the region of the trumpet-shaped portion 501*c* of the hollow conductor, in which recesses the snap devices 604, formed as brackets, can engage. The brackets 604 or the fastening device 604 exert(s) a force which is directed towards the wall 502 of the hollow conductor and thus holds the protection apparatus 508 on the hollow conductor 501*b*, 501*c*. The pressure on the wall 502 can be increased by the wall element 503 or wall device 503. In other words, the protection apparatus 508 encloses or encapsulates the hollow conductor from an external region. The snap device can ensure that the protection apparatus 508 cooperates with the housing wall 503 of the antenna device. A sealing effect can be achieved by corresponding surfaces adjoining one another. The wall device 502 comprises a further cavity 530.

The diameter of the hollow conductor 501 is determined by the signal frequency or used frequency at which the HF module operates. Thus, for different HF modules, a different antenna-hollow conductor system 120, 500 can be provided in each case.

The protection apparatus 508 is designed as a conical protection apparatus, so that a conical cavity 605 is produced as a continuation of the trumpet-shaped cavity 501*c* of the hollow conductor. The conical cavity 605 is designed such that the protection apparatus 508 has a uniform or homogeneous wall thickness beginning from the bearing surface 603.

FIG. 6 also shows the wall region 606 which is in contact with the fastening device 604. Said wall region 606 is located in the vicinity of the coupling region 506 of the antenna device 503. The wall region 606 exerts a pressure on the fastening device 604 parallel to the hollow conductor opening 630, parallel to the bearing surface 603 and/or parallel to the edge surface 602. The pressure may be high, since the pressure is absorbed by the wall device 531 of the housing device 502 of the hollow conductor 501*c*. The round shape of the hollow conductor 501*c* favours high force absorption. The sealing effect can be adjusted by means of the pressing forces.

The antenna 507 or the antenna hollow conductor 507 is incorporated into the wall region 606 of the antenna housing device 503. The antenna 507 or the antenna hollow conductor 507 may be a recess in the housing wall 606 of the antenna housing device 503 which is coated with a conductive material. The conical blocking device 609 of the conical protection apparatus 508 projects into the antenna pipe 507.

The wall region 607 of the hollow conductor end 501*c* is at a distance from a wall region 608 of the antenna wall. The spacing is produced by the hollow conductor housing device 502 and/or the wall 531, 631 thereof and the protection device 508, in particular the fastening means 604 thereof.

In the coupling region 506, the housing wall 531 of the housing adapter 502 or of the hollow conductor 501 and the wall 606 of the housing device 503 of the antenna region 507 overlap. It is therefore possible for the antenna wall 606 to exert a force on the fastening device 604 in the direction of the hollow conductor 501*c* and to substantially seal the transition from the antenna region 507 into the hollow conductor 501*c*.

The antenna device 507 comprises the process separation 509 at a lower end which is directed towards a filling material and is shown by the letter "B" in FIG. 5. The process separation 509 is designed in a lens shape and covers the antenna opening 510 such that substantially no direct transition can occur from the filling material region "B" or the process region "B" into the interior of the antenna device 507. FIG. 5 thus shows a level radar-antenna system 500 comprising a process separation 509, a condensate barrier 508 and an Exd separating element 505.

Figure 7:
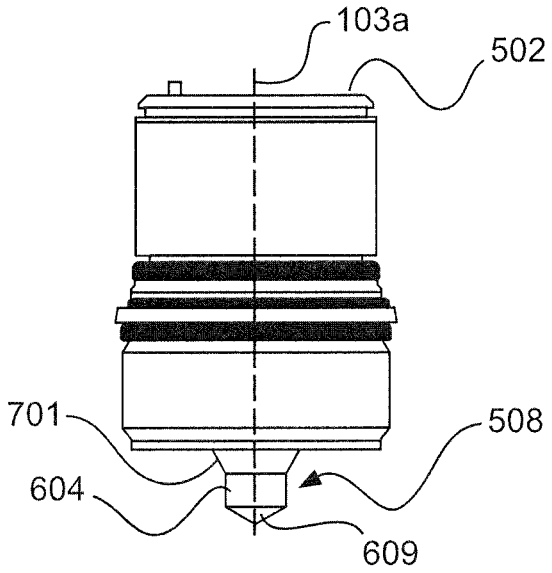
FIG. 7 shows a side view of a housing adapter according to an exemplary embodiment of the present invention.

FIG. 7 shows a side view of the hollow conductor housing element 502 or the housing adapter 502. A protection apparatus 508, formed in one piece, is arranged on the housing adapter 502, which apparatus comprises the fastening device 604 and the blocking device 609. The blocking device 609 and the fastening device 604 are produced from the same material.

Dielectrically conductive material, for example PTFE, PEEK, PFA or elastomers, such as in the case of O-rings, may be used as the material for the blocking device 100, 100*a*, 100*b*, 100*c*, 110*a*, 110*b*, 609. FKM, FFKM and silicone may also be used. PFA can be particularly suitable for production as an injection-moulded part, i.e. for production in one piece or in a monolithic manner. Simple assembly of the blocking apparatuses in the hollow conductor is possible on account of the arrangement of the blocking apparatus in the hollow conductor. In particular, the design in one piece permits simple assembly.

The housing adapter 502 is a cylindrical body having a tapering or pointed end region 701. Said end region 701 is located in the region of a hollow conductor end 501*c* (not shown in FIG. 7) in the interior of the housing adapter 502. The diameter of the neck-like end region 701 or the housing neck 701 is narrower than the diameter of the housing adapter, such that the housing adapter 502 acquires a bottle-like shape. As shown in FIGS. 5 and 6, the housing adapter 502 can be releasably connected to an antenna housing device 503. In this way, the conical blocking device 609 can emit an electromagnetic wave from the housing adapter towards the point of the cone. It is also possible to receive an electromagnetic wave through the blocking device 508 in the opposite direction from the point of the cone of the conical blocking device 609 and to transport said wave onwards in the interior of the housing adapter in the hollow conductor system 501 present therein. The condensate barrier 508 or blocking device 508 prevents moisture and/or other material from penetrating into the interior of the housing adapter 502. The hollow conductor 501 and the antenna device 507 are substantially hollow.

Figure 8:
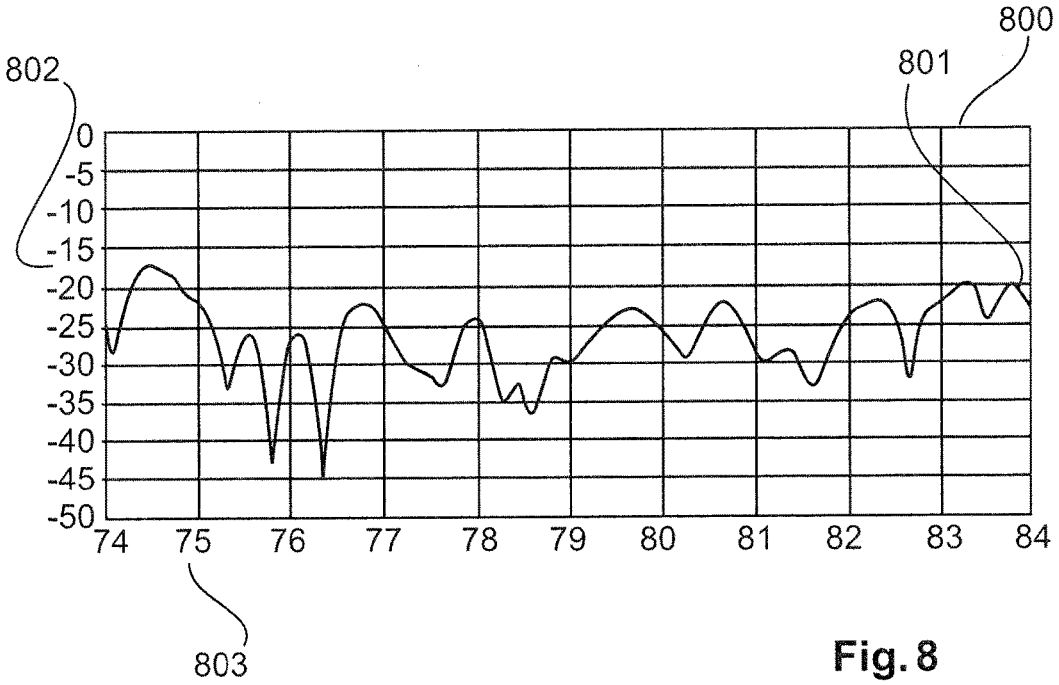
FIG. 8 shows a diagram of the adaptation parameter S11 over the frequency according to an exemplary embodiment of the present invention.

FIG. 8 shows a diagram of the S-parameters over the frequency according to an exemplary embodiment of the present invention. In particular, the adaptation parameter S11 which describes the reflective properties is shown in FIG. 8. The diagram in FIG. 8 relates to the hollow conductor-antenna system 500 of FIG. 5.

The curve 801 shown on the coordinate system 800 is a reflection curve showing the portion of an electromagnetic wave which is reflected on a protection apparatus 100, 508. The ordinate or Y-axis 802 shows an adaptation curve S11 in the unit dB, which curve has the negative values of from −50 dB to 0 dB. The abscissa or X-axis 803 shows the frequency in GHz, which ranges from 74 GHz to 84 GHz. It can be seen that the reflection curve 801 has a substantially constant course.

Figure 9:
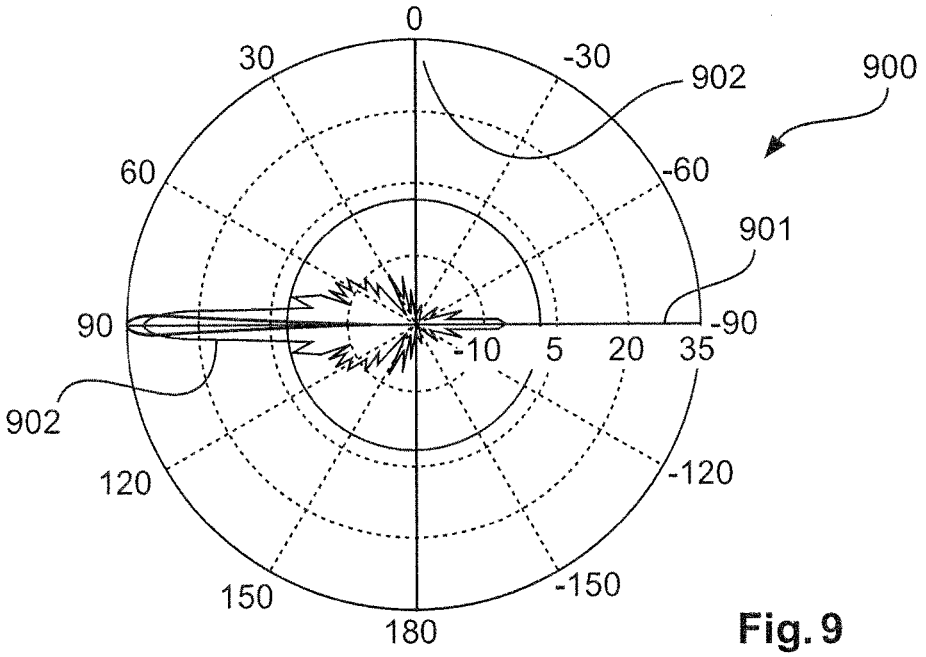
FIG. 9 shows a far field region of an antenna characteristic according to an embodiment of the present invention.

FIG. 9 shows a far field region of an antenna characteristic of a hollow conductor-antenna system 120, 505 which can be reached using an antenna device 107, 507. The presentation in FIG. 9 relates to the hollow conductor-antenna system 500 of FIG. 5. The polar coordinate system 900 shows the field strength in the radial direction and the radiation angle in the polar direction. In other words, FIG. 9 shows the longitudinal axis 103, 103*a* of the hollow conductor-antenna system by the polar axis 901 at +90 degrees. A transmission wave emitted from the HF module in the HF module cavity 105 would move towards the left-hand side in FIG. 9. It should be noted that a main lobe of the field diagram 902 is formed in the radiation direction, i.e. towards the left. Said lobe is rotated about 90 degrees proceeding from an axis of origin 902.

In addition, it is pointed out that the terms "comprising" and "having" do not exclude any other elements or steps and "a" or "one" do not exclude a plurality. It should further be noted that features or steps which have been described with reference to one of the above embodiments may also be used in combination with other features or steps of other above-described embodiments. Reference numerals in the claims should not be interpreted as limiting.

The invention claimed is:

1. A housing apparatus, comprising:

a hollow conductor which is adapted for guiding an electromagnetic wave having a predeterminable wavelength and which comprises an edge surface which extends substantially perpendicularly to the propagation direction of an electromagnetic wave guided by the hollow conductor;

a wall element;

an antenna device which is a separate component from the hollow conductor and which is connected to the hollow conductor; and a protection apparatus comprising a bearing surface, the protection apparatus arranged between the hollow conductor and the antenna device;

wherein the wall element is formed at least in part as the antenna device;

wherein the antenna device comprises a process separation and/or a filling at one end, wherein the process separation and/or the filling covers an antenna opening formed by the antenna device;

wherein the protection apparatus is arranged on an end of the hollow conductor;

wherein the bearing surface of the protection apparatus is in abutting contact with the edge surface of the hollow conductor;

wherein the protection apparatus protects the hollow conductor from at least one of moisture, matter or material;

wherein the protection apparatus further includes a fastening device fastening the protection apparatus to an end of the hollow conductor so that the fastening device is in abutting contact with the hollow conductor;

wherein the wall element is in abutting contact with the fastening device; and wherein the hollow conductor includes a housing element, the housing element having recesses formed in an outer circumferential surface of the housing element, wherein with which the fastening device engages with the recesses.

2. The housing apparatus according to claim 1, wherein the protection apparatus further comprises:

a blocking device;

wherein the blocking device has a predeterminable sealing effect and is non-transmissible to material in the direction of the hollow conductor, wherein a portion of the blocking device is in a path of the guided electromagnetic wave; and wherein the blocking device comprises a bearing surface which is kept in direct contact with the edge surface of the hollow conductor by the fastening device;

wherein the protection apparatus has a longitudinal axis which extends perpendicularly to the bearing surface.

3. The housing apparatus according to claim 2, wherein the blocking device is formed in the shape of a disc, a cone, a lens and/or a sphere.

4. The housing apparatus according to claim 1, wherein the protection apparatus is formed in one piece.

5. The housing apparatus according to claim 1, wherein the fastening device is designed as a snap fastener having at least one bracket which engages at least one of the recesses.

6. The housing apparatus according to claim 1, wherein the fastening device comprises a press-in ring.

7. The housing apparatus according to claim 6, wherein the blocking device is formed as a film.

8. The housing apparatus according to claim 7, wherein the press-in ring is a stainless steel ring;

wherein the film has a predeterminable sealing effect and is substantially permeable to an electromagnetic wave;

wherein the stainless steel ring has at least two openings;

wherein the film is laminated onto the stainless steel ring in such a way that it seals one of the two openings of the stainless steel ring.

9. The housing apparatus according to claim 1, wherein the protection apparatus is formed from a material which is selected from the group of materials consisting of a dielectric material, PFA, PTFE, PEEK, PFA, FKM, FFKM and silicone.

10. The housing apparatus according to claim 1, wherein the antenna device is adapted for guiding and beam forming of an electromagnetic wave received by the hollow conductor.

11. The housing apparatus according to claim 1, wherein the antenna device is configured to be separable from the housing apparatus.

12. The housing apparatus according to claim 1, wherein the process separation and/or the filling is arranged behind the protection apparatus when viewed in a transmission direction of the electromagnetic wave.

13. The housing apparatus of claim 1, wherein a portion of an inner circumferential surface of the wall element is in abutting contact with the fastening device.

14. A field device comprising:

a sensor;

a housing apparatus, comprising:

a hollow conductor which is adapted for guiding an electromagnetic wave having a predeterminable wavelength and which comprises an edge surface which extends substantially perpendicularly to the propagation direction of an electromagnetic wave guided by the hollow conductor;

a wall element;

an antenna device which is a separate component from the hollow conductor and which is connected to the hollow conductor; and a protection apparatus comprising a bearing surface, the protection apparatus arranged between the hollow conductor and the antenna device;

wherein the wall element is formed at least in part as an antenna device;

wherein the antenna device comprises a process separation and/or a filling at one end, wherein the process separation and/or the filling covers an antenna opening formed by the antenna device;

wherein the protection apparatus is arranged on an end of the hollow conductor;

wherein the bearing surface of the protection apparatus maintains is in abutting contact with the edge surface of the hollow conductor;

wherein the sensor is adapted for generating and/or receiving an electromagnetic wave;

wherein the protection apparatus protects the hollow conductor from at least one of moisture, matter or material;

wherein the protection apparatus further includes a fastening device fastening the protection apparatus to an end of the hollow conductor so that the fastening device is in abutting contact with the hollow conductor;

wherein the wall element is in abutting contact with the fastening device; and wherein the hollow conductor includes a housing element, the housing element having recesses formed in an outer circumferential surface of the housing element, wherein the fastening device engages with the recesses.

15. The field device of claim 14, wherein a portion of an inner circumferential surface of the wall element is in abutting contact with the fastening device.

16. A protection apparatus for a hollow conductor which is adapted for guiding an electromagnetic wave having a predeterminable wavelength and which comprises an edge surface which extends substantially perpendicularly to the electromagnetic wave guided by the hollow conductor; the protection apparatus comprising:

a fastening device fastening the protection apparatus to an end of the hollow conductor so that the fastening device is in abutting contact with the hollow conductor;

an antenna device which is a separate component from the hollow conductor and which is connected to the hollow conductor; and a blocking device arranged between the hollow conductor and the antenna device;

wherein the blocking device has a predeterminable sealing effect and is non-transmissible to material in the direction of the hollow conductor, wherein a portion of the blocking device is in a path of the guided electromagnetic wave; and wherein the blocking device comprises a bearing surface which is kept in substantially direct contact with the edge surface of the hollow conductor by the fastening device;

wherein the protection apparatus has a longitudinal axis which extends perpendicularly to the bearing surface;

wherein the protection apparatus protects the hollow conductor from at least one of moisture, matter or material;

wherein a wall element is formed at least in part as the antenna device and is in abutting contact with the fastening device; and wherein the hollow conductor includes a housing element, the housing element including recesses formed in an outer circumferential surface of the housing element, wherein the fastening device engages with the recesses.

17. The protection apparatus of claim 16, wherein a portion of an inner circumferential surface of the wall element is in abutting contact with the fastening device.

18. A method for producing a protection apparatus, comprising:

providing a stainless steel ring to fasten the protection apparatus to an end of a hollow conductor so that the protection apparatus is in abutting contact with the hollow conductor, wherein the hollow conductor includes a housing element with recesses formed in an outer circumferential surface of the housing element, so that the stainless steel ring is engageable with the recesses, wherein the stainless steel ring being is in abutting contact with a wall element which has a predeterminable external diameter;

providing a film which has a predeterminable sealing effect from at least one of moisture, matter or material and which is substantially permeable to an electromagnetic wave;

laminating the film onto the stainless steel ring in such a way that at least one of the two openings of the stainless steel ring is sealed by the film, wherein the film is arranged between the hollow conductor and an antenna device, the antenna device being a separate component from the hollow conductor and being connected to the hollow conductor, wherein the wall element is formed at least in part as the antenna device;

cutting the film in such a way that it aligns with the external diameter of the stainless steel ring.

* * * * *